United States Patent [19]

Gollinger et al.

[11] Patent Number: 4,961,379

[45] Date of Patent: Oct. 9, 1990

[54] OFFSET PRINTING MACHINE WITH READILY ACCESSIBLE ACCESSORY APPARATUS

[75] Inventors: Franz X. Gollinger, Hirschbach; Wendelin Menzinger, Dasing, both of Fed. Rep. of Germany

[73] Assignee: MAN Roland Druckmaschinen AG, Offenbach am Main, Fed. Rep. of Germany

[21] Appl. No.: 416,103

[22] Filed: Oct. 2, 1989

[30] Foreign Application Priority Data

Oct. 15, 1988 [DE] Fed. Rep. of Germany ..... 3835188

[51] Int. Cl.[5] ..... B41F 5/04

[52] U.S. Cl. ..... 101/219; 101/DIG. 35; 101/350; 101/479

[58] Field of Search ..... 101/216, 219, 220, 348–350, 101/479, 132, 136, 147, 148, 178, 179, 206–208, DIG. 35; 271/271–274

[56] References Cited

U.S. PATENT DOCUMENTS

| | | | |
|---|---|---|---|
| 1,496,454 | 6/1924 | Dudley | 101/349 |
| 2,181,714 | 11/1939 | Vandercook et al. | 101/DIG. 35 |
| 2,206,712 | 7/1940 | Babson | 101/350 |
| 2,227,616 | 1/1941 | Wolf | 101/220 |
| 2,248,926 | 7/1941 | Meisel | 101/220 |
| 2,288,174 | 6/1942 | Wood et al. | 101/350 |
| 2,460,504 | 2/1949 | Huebner | 101/479 |
| 2,585,325 | 2/1952 | Imshaug | 101/479 |
| 2,854,924 | 10/1968 | Ault | 101/350 |
| 2,908,221 | 10/1959 | Brodie | 101/350 |
| 3,572,601 | 3/1971 | Miller | 101/219 |
| 4,572,069 | 2/1986 | Schwarzbeck | 101/216 |

FOREIGN PATENT DOCUMENTS

| | | |
|---|---|---|
| 861565 | 4/1952 | Fed. Rep. of Germany . |
| 2718299 | 11/1977 | Fed. Rep. of Germany . |
| 2949872 | 7/1980 | Fed. Rep. of Germany . |

*Primary Examiner*—Eugene H. Eickholt

*Attorney, Agent, or Firm*—Frishauf, Holtz, Goodman & Woodward

[57] ABSTRACT

To permit access to accessory apparatus, such as inkers or dampers, or parts thereof, through an opening in the side wall of the printing machine which is so small, for reasons of printing machine stability, that normal access thereto is impaired, at least part of the accessory apparatus is located on a slide carriage (27) which is supported similar to a suspension slide on a carriage support rail (28). The carriage support rail (28) is secured to one side wall with a pivot hinge, so that it can be pivoted laterally, horizontally, to remove the part of the accessory apparatus by sliding it outwardly on the slide carriage. A holder extension (39) slidable on the support (38) is secured to the other side wall (1) of the printing machine supports the carriage support rail and provides an end stop for the accessory apparatus when the carriage support rail is swung outwardly.

16 Claims, 3 Drawing Sheets

33
31
29
26
32
2
22
25
23
27
22
23
34
28
35
39
38
1
30
2
22
27
22
1
34
28
2
27
34
38
1
39
28

OFFSET PRINTING MACHINE WITH READILY ACCESSIBLE ACCESSORY APPARATUS

The present invention relates to offset printing machines, and more particularly to offset printing machines in which accessory apparatus such as inkers or dampers are located at positions within the printing machines which are not readily accessible for maintenance, cleaning, or the like.

BACKGROUND

Rotary web-type offset printing machines, for example offset printing machines used for newspaper printing or the like, frequently have printing couples constructed in four-cylinder form. Two plate cylinders cooperate with two blanket cylinders, the blanket cylinders being positioned to pass a continuous web of paper therebetween and, at the same time, printing prime and verso subject matter. The printing couples are customarily located on a frame which, in general, has an inverted U or inverted channel configuration, and, therefore, such machines or the printing units thereof are also referred to as U-units. In essence, two vertical legs are connected by a bridge element. In the upper part of the bridge, two rubber blanket cylinders are journalled, located with their axes in a horizontal plane. The printing machine units are constructed in mirror-image form. The blanket cylinders simultaneously print on the prime and verso side of the web which is carried vertically therebetween. The plate cylinders are likewise located in horizontal alignment, below the blanket cylinders and, for example, outside and somewhat laterally therefrom. The dampers for the printing units are located inwardly of the plate cylinders. Access to the dampers is impaired since the narrow gap in the middle of the side walls is accessible only with difficulty. During operation, the web runs vertically in the middle of the gap between the legs. Maintenance on the dampers is thus possible only after severing the web. This increases the time and paper loss merely to permit maintenance or other work on the dampers, and eventually requires re-threading of the paper web.

Some printing machines also have their inkers located in positions inwardly of the plate cylinders.

THE INVENTION

It is an object to provide a printing machine system in which the accessory apparatus, such as inkers or dampers of such an offset printing machine is accessible, so that maintenance or repair on the accessory apparatus can be readily carried out so that, thereby, the economy of operation of the entire printing machine unit is improved.

Briefly, the accessory apparatus, or at least the parts thereof which require most maintenance, are located on a slide carriage which is supported on a carriage support rail secured to at least one of the slide walls of the machine. The slide carriage, on which, for example, a damper liquid ductor system is positioned, can be slid outwardly from the operative position through the opening. In accordance with a preferred feature of the invention, the carriage support rail is pivotably secured at one end to the side wall of the machine and at the other releasably coupled to the other side wall of the machine so that, in operative connection, the accessory apparatus is supported on the rail and slide carriage between the two side walls but, for maintenance, one of the attachment supports can be loosened and the rail, together with the accessory apparatus thereon, slid outwardly. A support bracket to support the accessory apparatus when moved out of the opening between the legs of the U-frame holds the accessory apparatus reliably in position.

The arrangement has the advantage that the parts of the accessory apparatus most subject to maintenance can be readily removed from their position within the machine and beneath the printing rollers to provide full and easy accessibility thereto, without interfering with the paper web. Thus, the paper web need not be severed merely to obtain access to the accessory apparatus, and require re-threading after maintenance.

The opening in the side wall of the machine can be of standard size and need not be increased, which might interfere with stability of the machine. In accordance with a preferred feature of the invention, the pivotal attachment of the rail, therefore, permits a narrow opening of the side wall while permitting the carriage together with the rail to assume an inclined position, with reference to the axis of rotation of the plate or blanket cylinder, for example, so that also those portions which, in working position, might be covered by the side wall of the machine, can be removed through a narrow opening between the legs of the U side wall.

DRAWINGS

DETAILED DESCRIPTION

Figure 1:
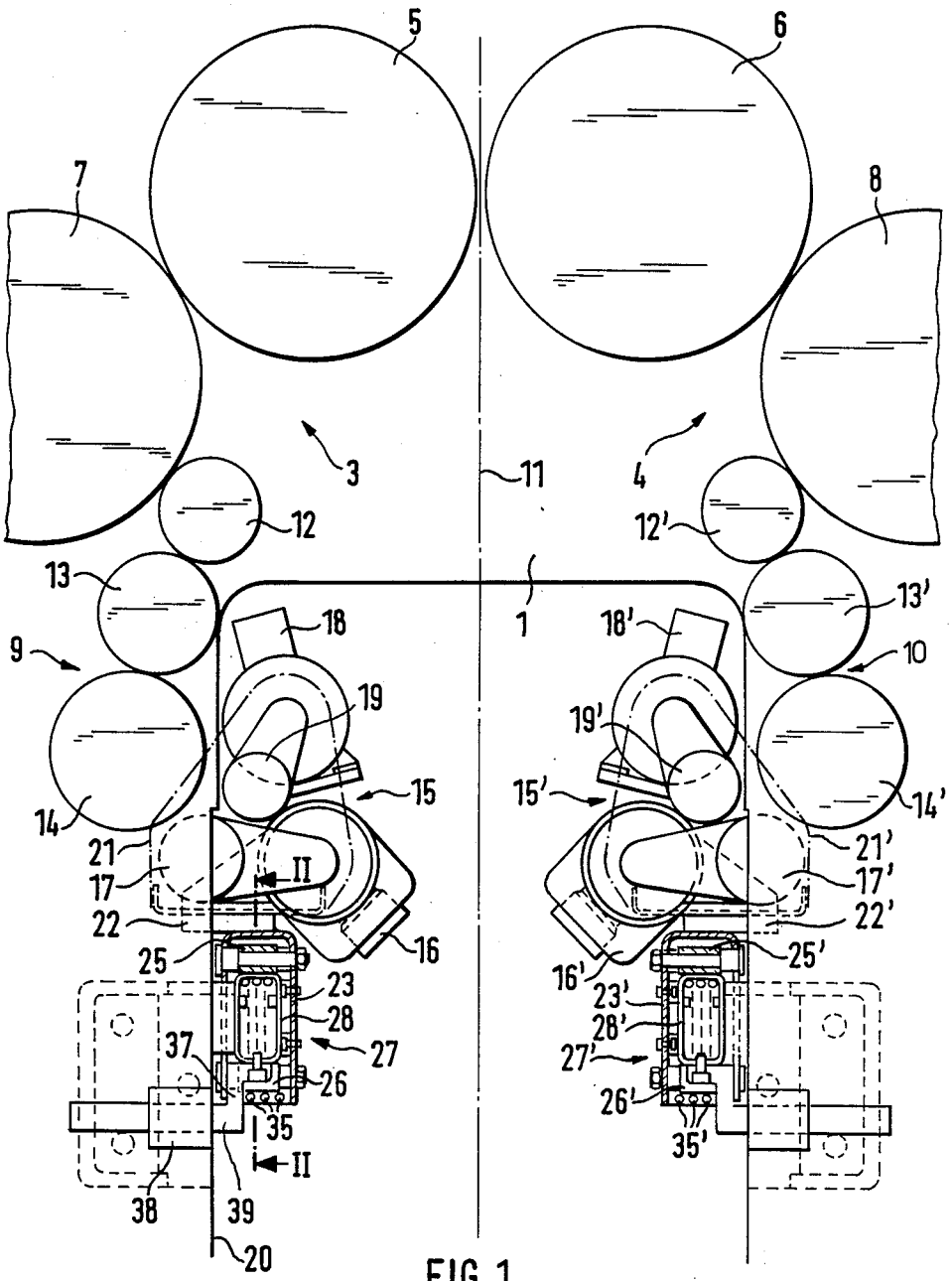
FIG. 1 is a fragmentary side view of a U printing machine system, in which it is assumed that the side wall is transparent, for better illustration.
Figures 2, 3, 4:
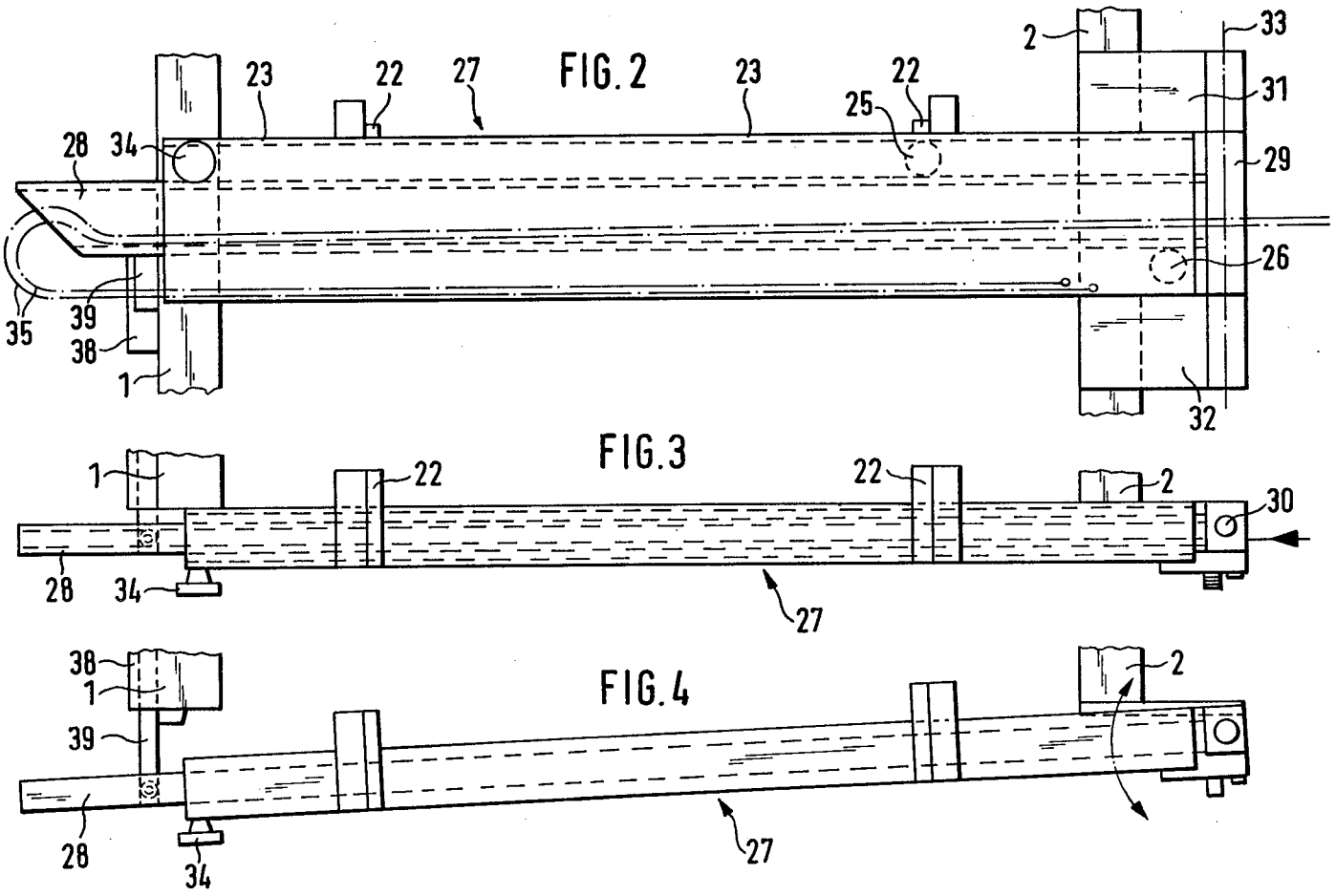
FIG. 2 is a longitudinal section through the carriage and support rail along line II—II of FIG. 1;-
FIG. 3 is a top view of the section of FIG. 2, with the carriage and rail in working position.
FIG. 4 is a view similar to FIG. 3, with the carriage and rail laterally pivoted outwardly.

The printing machine has two side walls 1, 2 (FIGS. 1 and 2) which, as best seen in FIG. 1, have the general shape or outline of an inverted U. Symmetrically thereon, two printing units 3, 4 of a four-cylinder offset printing system are located between the side walls. Each one of the printing units 3, 4 includes a blanket cylinder 5, 6, a plate cylinder 7, 8, a damper 9, 10 and an inker. The inkers may be located laterally outside of the illustration of FIG. 1 and, therefore, are not shown since they may be of any standard and well known construction; in some installations, however, the inkers may be placed essentially in the position of the dampers 9, 10. Since the invention is not limited to the specific printing machine shown in FIG. 1, the apparatus which is subject to removal through the opening between the legs of the inverted U, is identified, generally, as "accessory apparatus".

Blanket cylinders 5, 6 are located at the same level in the upper horizontal bridge portion of the machine between side walls 1, 2. They can be engaged against each other in accordance with well known structures, in order to provide for perfecting printing of a web 11 carried between the blanket cylinders 5, 6. The web 11 also forms the axis of symmetry between the printing units 3, 4.

The damper 9 has a plurality of damping rollers 12, 13, 14. The lower ones of the damping rollers 12, 13, 14 are journalled in one of the upright legs of the machine side walls 1, 2. A damping application system 15 provides damping fluid to the rollers 12–14. The application system 15 is formed by a variable-speed gear motor 16 which drives a damping ductor roller 17 over a suitable drive, for example a belt; a further motor 18 is coupled via a belt drive to a brush roller 19. The brush roller 19 receives damping liquid from the surface of the ductor roller 17 and slings or flings the damping liquid on the damping roller 14, from which a damping liquid film, for example water, is transferred by the damping liquid rollers 13 and 12 to the plate cylinder 7.

The damping liquid application system 15 is shown in FIG. 1 in working position. A portion thereof is covered by the machine side wall; another portion is accessible through the opening 20 between the legs of the machine side wall, and hence is clearly visible. The opening 20 should be as small as possible in order to provide for stability of the machine printing system. This limitation on the size of the opening 20 substantially impedes access to the damping system and particularly to the application system 15 when the web 11 is threaded between the blanket cylinders 5, 6, as is clearly apparent in FIG. 1.

Figure 5:
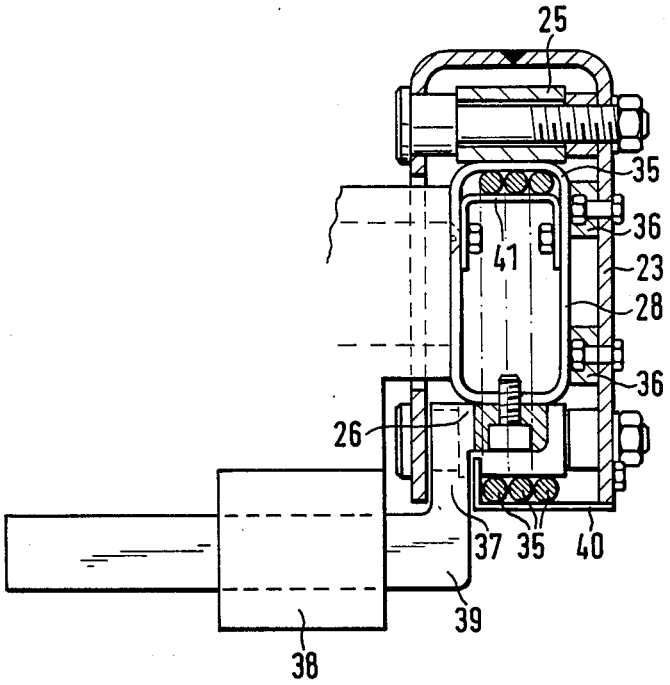
FIG. 5 is an enlarged fragmentary cross section through the carriage and the support rail.

In accordance with a feature of the invention, and to improve accessibility, the damping fluid application system 15, forming a portion or part of the damper 9, is secured, as a unit, on an auxiliary frame 21 which, in turn, is secured to a base plate 22 and via the base plate 22 to the upper side of a U-shaped rail 23. The U-shaped rail 23 (see FIGS. 1 and 5) has rollers 25, 26 located at the upper and lower portions thereof, in the form of a suspension slide. More than one roller 25, 26 may be located in the rail 23, longitudinally staggered thereon. The rail 23, and the rollers 25, 26, or similar rollers axially staggered, together form a movable carriage 27 (FIGS. 1, 5).

The carriage 27 is longitudinally movable, by running on a support rail 28. Support rail 28 is constructed in form of a hollow rail of essentially rectangular cross section, forming a hollow box structure. The upper roller, or rollers 25, is engaged against the upper surface of the support rail 28; the lower roller, or rollers 26, engages at the lower side of the support rail 28.

Support rail 28 is coupled to an extension element 29 (FIG. 2) at the rearward portion thereof. Element 29 has a vertical bore or opening 30 therethrough. The extension 29 is coupled to a pair of support plates 31, 32, formed with bores matching the bore 30 of the extension 29. The plates 31, 32 are, for example, welded to the side wall 2 of the machine. A through-bolt 33 couples the extension 29 to the plates 31, 32 and hence to the side wall 2. Extension 29 support plates 31, 32 and the bolt 33 form a hinge by which the rail 28 can be moved or pivoted horizontally. When in operative position, the carriage 27 is secured to the machine side wall 1 by a knurled attachment screw 34, mounted so that it cannot be lost, for example secured by a C-washer. The knurled screw 34 simultaneously can serve as a handle to slide the carriage 27 outwardly.

Energy supply and control cables 35 to control the motors 16, 18, i.e. the necessary cables 35, are located in cable troughs 40, 41 (FIG. 5) within the support rail 28, and beneath the U-rail 23. They are so secured that, when the carriage 27 is slid outwardly, they can stretch, under resilient spring loading, and return to their initial position when the carriage 27, and hence the damper part 15, is in working condition.

OPERATION

Should it be necessary to carry out maintenance work on the damper, the printing machine is stopped, the knurled screw 34 is loosened, and the rail 28 is pivoted towards the right (FIG. 1) until the damper application part !5 is visible within the opening 20 of the machine side wall 1. The carriage 27, together with the damper application part 15, is then slid longitudinally along the rail 28, laterally outside of the printing machine. The carriage 27 is supported by the upper roller or rollers 25; the lower roller 26 functions as a counter pressure roller. The cables 35 can stretch, resiliently, and return, upon return of the carriage, to working position into their position in the respective troughs.

Lateral guidance of the carriage 27 on the rail 28 is obtained by slider strips 36 located at the inside of the U-shaped rail element 23 (see FIG. 5). Alternatively, rollers 25, 26 may be constructed with overlapping flanges—not shown in FIG. 5—rather than being merely cylindrical sleeves. The flanges will be positioned to engage around the side walls of the support rail 28.

The carriage 27 is protected against excess withdrawal from the machine by an end stop 37 secured to a support extension 39 which is movably retained in a holder 38, which, in turn, is secured to the machine side wall 1. The support extension 39 is coupled to a lower part of the support rail 28 for limited movement so that, when the support rod 28 is pivoted, the support extension can slide outwardly of the attachment 38, so that at the same time, it supports the rail 28 when the carriage is pulled out.

The damper 10 at the right side of the web 11 (FIG. 1) is the mirror image of, and otherwise identical to the damper 9. Identical parts have been given the same reference numerals with prime notation; since the operation, also, is identical, considering the mirror-image relationship, it need not be described again.

The use of the carriage on a support rod is not limited to a damping system, or a fluid application part of a damping system. The invention can be used with any accessory apparatus, where the apparatus, or parts thereof, is positioned in the printing machine at locations of impaired accessibility, to facilitate maintenance and other work on the machine.

Various changes and modifications may be made within the scope of the inventive concept.

We claim:

1. Offset printing machine having
   two side walls (1, 2) and accessory apparatus (9, 9') subject to maintenance,
   wherein said accessory apparatus is positioned between said side walls at locations of impaired accessibility, said printing machine comprising
   a carriage support (28) pivotably secured to at least one (2) of the side walls (1, 2) of the machine; and
   a slide carriage (27) supporting at least part of said accessory apparatus movably on said carriage support, to permit moving said part of the accessory apparatus; and
   wherein said carriage support (28) is positioned on said at least one side wall to permit said part of the accessory apparatus to be moved laterally outwardly of the printing machine.

2. The machine of claim 1, wherein said accessory apparatus comprises at least one of:
   an inker;

a damper.

3. The machine of claim 1, further including a support extension (39) located on the other side wall (1) of the printing machine:

and support means (38) attached to said other side wall (1) of the printing machine and movably holding said support extension on said other side wall.

4. The machine of claim 3, wherein said means holding said support extension on the other side wall hold said support extension for sliding movement with respect to said other side wall.

5. The machine of claim 3, further including a stop element (37) secured to said support extension (39) to define a terminal position of said slide carriage laterally outwardly of the printing machine.

6. The machine of claim 1, wherein said slide carriage (27) comprises a U-shaped structure (23) open towards the bottom;

at least one upper roller (25) located at an upper region of the U-shaped structure and bearing against the upper side of the carriage support (28); and at least one lower roller (26) located at a lower portion of the U-shaped rail and engaging against a lower surface of said carriage support (28).

7. The machine of claim 6, wherein said carriage support comprises an essentially box-shaped hollow structural element.

8. The machine of claim 7, further including a first cable trough (40) located beneath said box-shaped structural element (28) and second cable trough (41) located at the inside of the U-shaped structural element;

and electrical cables (35) located in said cable troughs for electrical energy supply and control of electric motors (16, 18) forming part of said accessory apparatus.

9. The machine of claim 1, wherein said carriage support (28) comprises an essentially box-shaped hollow structural element.

10. The machine of claim 1, wherein said accessory apparatus comprises a damping fluid application means (15) forming part of a damper (9, 9') and including an auxiliary frame (21) and a base plate (22), said base plate being secured to said slide carriage (27).

11. The machine of claim 1, further including an auxiliary frame (21) and a base plate (22),said base plate being secured to said slide carriage (27) and said auxiliary frame (21) retaining said part of the accessory apparatus in position within the printing machine.

12. The machine of claim 1, further including releasable attachment means (34) releasably coupling said at least part of the accessory apparatus to the other (1) of the side walls of the printing machine when said accessory apparatus is in operative or working position in the printing machine.

13. Offset printing machine having two side walls (1, 2) and accessory apparatus (9, 9') subject to maintenance, wherein said accessory apparatus is positioned between said side walls at locations of impaired accessibility, said printing machine comprising a carriage support (28) secured to at least one (2) of the side walls (1, 2) of the machine; and a slide carriage (27) supporting at least part of sand accessory apparatus movably on said carriage support, to permit moving said part of the accessory apparatus;

wherein said carriage support (28) is positioned on said at last one side wall to permit said part of the accessory apparatus to be moved laterally outwardly of the printing machine.

wherein said slide carriage (27) comprises a U-shaped structure (23) open towards the bottom;

at least one upper roller (25) located at an upper region of the U-shaped structure and bearing against the upper side of the carriage support (28); and at least one lower roller (26) located at a lower portion of the U-shaped rail and engaging against a lower surface of said carriage support (28).

14. Offset printing machine having two side walls (1, 2) and accessory apparatus (9, 9') subject to maintenance, wherein said accessory apparatus is positioned between said side walls at locations of impaired accessibility, said printing machine comprising a carriage support (28) secured to at least one (2) of the side walls (1, 2) of the machine; and a slide carriage (27) supporting at least part of said accessory apparatus movably on said carriage support, to permit moving said part of the accessory apparatus;

wherein said carriage support (28) is positioned on said at least one side wall to permit said part of the accessory apparatus to be moved laterally outwardly of the printing machine; and wherein said carriage support (28) comprises an essentially box-shaped hollow structural element.

15. Offset printing machine having two side walls (1, 2) and accessory apparatus (9, 9') subject to maintenance, wherein said accessory apparatus is positioned between said side walls at locations of impaired accessibility, said printing machine comprising a carriage support (28) secured to at least one (2) of the side walls (1, 2) of the machine; and a slide carriage (27) supporting at least part of said accessory apparatus movably on said carriage support, to permit moving said part of the accessory apparatus;

wherein said carriage support (28) is positioned on said at least one side wall to permit said part of the accessory apparatus to be moved laterally outwardly of the printing machine; and further including an auxiliary frame (21) and a base plate (22), said base plate being secured to said slide carriage (27) and said auxiliary frame (21) retaining said part of the accessory apparatus in position within the printing machine.

16. The machine of claim 15; wherein said accessory apparatus comprises a damping fluid application means (15) forming part of a damper (9, 9').

* * * * *